US005589093A

United States Patent [19]

Chen

[11] Patent Number: 5,589,093

[45] Date of Patent: Dec. 31, 1996

[54] MICROWAVE HEATING CHAMBER FOR VENDING MACHINES

[75] Inventor: Jey-Cherng Chen, Hsin Chu, Taiwan

[73] Assignee: Electronics Research & Service Organization, Hsinchu, Taiwan

[21] Appl. No.: 504,731

[22] Filed: Jul. 20, 1995

[51] Int. Cl.[6] ..... H05B 6/80

[52] U.S. Cl. ..... 219/679; 219/762; 219/695; 221/150 A

[58] Field of Search ..... 219/679, 762, 219/763, 756, 695, 694, 696; 221/150 HC, 150 A, 154

[56] References Cited

U.S. PATENT DOCUMENTS

| | | | |
|---|---|---|---|
| 4,398,651 | 8/1983 | Kumpfer | 221/150 HC |
| 4,677,278 | 6/1987 | Knoll | 219/214 |
| 4,784,292 | 11/1988 | Johndrow et al. | 221/150 HC |
| 4,848,591 | 7/1989 | Wada | 221/150 A |
| 5,011,042 | 4/1991 | Bunce et al. | 221/150 A |
| 5,105,979 | 4/1992 | Bakx et al. | 221/150 HC |
| 5,250,773 | 10/1993 | Lind et al. | 219/690 |

*Primary Examiner*—Philip H. Leung
*Attorney, Agent, or Firm*—Barnes, Kisselle, Raisch, Choate, Whittemore & Hulbert, P.C.

[57] ABSTRACT

A microwave heating chamber for use in a vending machine including a cylindrically shaped chamber, retractable upper and lower end plates for defining a chamber cavity, a retractable object holding plate for supporting an object to be heated at a position of maximum microwave energy, and a microwave generator for generating the microwave energy wherein the heating chamber allows the rapid heating of an article positioned in the chamber due to its small chamber volume and its cylindrically shaped cavity.

18 Claims, 1 Drawing Sheet

MICROWAVE HEATING CHAMBER FOR VENDING MACHINES

FIELD OF THE INVENTION

The present invention generally relates to a microwave heating chamber for use in a vending machine and more particularly, relates to a microwave heating chamber for use in a vending machine that is cylindrically shaped allowing objects to be heated at maximum energy level such that only a short heating time is required.

BACKGROUND OF THE INVENTION

The technology of using microwave energy for heating an object to a higher temperature has been used for many years. It is especially popular in the food service industry where microwave ovens are widely used. Most microwave ovens are designed with a heating chamber of a rectangular shape and a large volume. The microwave energy is dispersed inside the heating chamber and therefore is not available in a concentrated form. As a result, the time required for heating an object, even though shorter than a conventional convection oven, is still quite appreciable. For instance, most food items, even of a small size, require a heating time of between two to five minutes. The lengthy heating time prohibits the use of microwave ovens in vending machines.

In a typical fast food vending machine, after a consumer deposits money into the machine and makes a selection, the selected item is immediately delivered to a discharge chute to the consumer. If a conventional microwave oven is used in such a machine, the heating time required even for a small food item would not be acceptable. A general survey indicates that a consumer demands that a food item to be heated and delivered to him in a very short period of time, i.e., less than 30 seconds.

It is therefore an object of the present invention to provide a microwave heating chamber for use in a vending machine that does not have the drawback of conventional microwave heating chambers which require long heating time.

It is another object of the present invention to provide a microwave heating chamber for use in a vending machine that is in a cylindrical shape to enable the formation of a maximum microwave energy zone inside the chamber.

It is a further object of the present invention to provide a cylindrically shaped microwave heating chamber for use in a vending machine capable of holding a food item at a predetermined position inside the chamber for exposure to maximum microwave energy.

It is another further object of the present invention to provide a cylindrically shaped microwave heating chamber for use in a vending machine equipped with an object holding plate such that an object may be heated in a short period of time.

It is still another object of the present invention to provide a cylindrically shaped microwave heating chamber for use in a vending machine equipped with an object holding plate such that an object may be heated to a desirable temperature in a time period of less than 30 seconds.

SUMMARY OFT HE INVENTION

In accordance with the present invention, a microwave heating chamber for use in a vending machine that is in a cylindrical shape and equipped with an object holding plate such that an object can be heated in a very short period of time to a desirable temperature is provided.

In the preferred embodiment, a microwave heating chamber for use in a vending machine is provided in a cylindrical shape and mounted vertically with retractable upper and lower end plates for completely sealing the chamber. The chamber wall and the end plates are made of a microwave non-transmissive and non-absorptive material. A retractable object holding plate is inserted in between the two end plates for holding the object to be heated. The plate is mounted at such a position that the object is exposed to the maximum microwave energy. This enables a quick heating of the object to a desirable temperature in a short period of time, i.e., less than 30 seconds. It is more preferred, in the case of a food item, to be heated to a suitable serving temperature in less than 20 seconds. A microwave generator is mounted in a mounting means which includes a circulator for preventing the back flow of microwave energy and possible damage to the microwave generator. The mounting means further includes a wave guide to facilitate the transmission of microwave energy into the heating chamber. The retractable upper and lower end plates and the retractable holding plate are controlled by a control means such that each plate can be withdrawn at a predetermined time. For instance, at the beginning of the operation, the upper end plate retracts to allow an object to fall onto the object holding plate. The upper end plate then returns to its original position to seal the chamber. The passing of the object is sensed by a sensing device in the wall which activates the microwave generator to generate microwave and sending into the chamber cavity for heating the object. After a preset time has passed, the object holding plate and the lower end plate are withdrawn to allow the object to fall into a discharge chute for picking up by the consumer. The novel heating chamber allows an object to be heated in a shorter period of time which makes it suitable for vending machine applications.

The present invention is further directed to a method of heating an object in a microwave chamber installed in a vending machine. The method utilizes a cylindrically shaped heating chamber such that microwave energy can be effectively concentrated at certain position inside the chamber cavity. The selection of a heating position for maximum microwave exposure allows a shorter heating time for heating the object to a desirable temperature.

BRIEF DESCRIPTION OF THE DRAWINGS

Other objects, features and advantages of the present invention will become apparent upon consideration of the specification and the appended drawings, in which.

DETAILED DESCRIPTION OF THE PREFERRED EMBODIMENT

The present invention describes a microwave heating chamber for use in a vending machine that has a small cylindrical shape such that microwave energy can be concentrated at a central location inside the chamber cavity to more efficiently and quickly heating an object.

Figure 1:
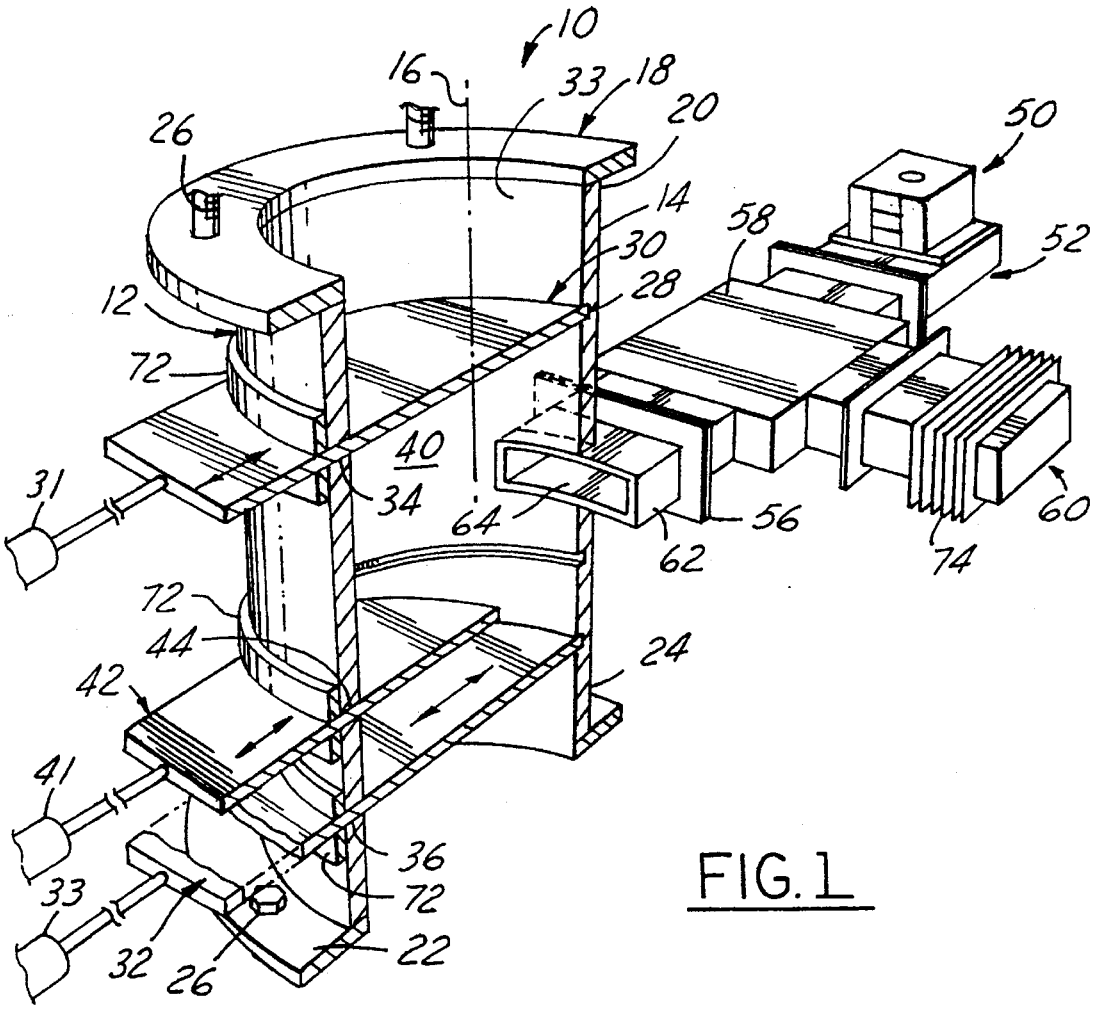
FIG. 1 is a perspective cut-away view of the present invention microwave heating chamber with the microwave generator attached thereto.

Referring initially to FIG. 1, wherein a perspective view of the present invention microwave heating chamber 10 is shown. The microwave heating chamber 10 has a cylindrically shaped chamber body 12 with a chamber wall 14 and a longitudinal axis 16. The cylindrically shaped chamber body 12 is equipped with an upper mounting flange 18 at the upper extremity 20 of the chamber body 12. The chamber body 12 is also equipped with a lower mounting flange 22 at the lower extremity 24 of the chamber body 12. The upper mounting flange 18 is adapted to receive an object (not shown) transported from a storage compartment (not shown) for admittance into chamber 10. The lower mounting flange 22 is adapted to deliver a heated object to a discharge chute (not shown) of the vending machine. The upper mounting flange 18 and the lower mounting flange 22 are each equipped with mounting means 26 for mounting mechanically to a vending machine.

The elongated cylindrically shaped chamber 12 is further equipped with a retractable upper end plate 30 and a retractable lower end plate 32 for sealingly engaging the inside peripheral area of the chamber body 12. The upper end plate 30 and the lower end plate 32 are positioned perpendicular to the longitudinal axis 16 of the chamber. The upper end plate 30 is controlled and positioned by a first mounting means (not shown) and a first retracting means (not shown) through a first slot opening 34 in the chamber wall 12 such that when the end plate 30 is fully extended into slot 28 cut into the inside surface 38 of chamber wall 14, it substantially seals off the upper end of chamber 12. Similarly, the lower end plate 32 is controlled and positioned by a second mounting means (not shown) and a second retracting means (not shown) through a second slot opening 36 in the chamber wall 12 such that when the lower end plate 32 is fully extended into slot 46 cut into the inside surface 38 of chamber wall 14, it substantially seals off the lower end of the chamber 10 and forms a substantially sealed chamber cavity 40 when the upper end plate 30 is also in a fully extended position. The first and second mounting means and the first and second retracting means enable the upper end plate 30 and the lower end plate 32 to move horizontally into and out of chamber 10 in a horizontal sliding motion.

The Chamber wall 12 and the upper retractable end plate 30, the lower retractable end plate 32 are made of a material that is substantially not transmissive or absorptive to microwave energy. For instance, materials such as stainless steel, aluminum or any other suitable metal can be used.

The microwave heating chamber 10 is further equipped with a retractable object holding plate 42 for supporting an object to be heated by microwave energy. The holding plate 42 is mounted parallel to the upper end plate 30 and the lower end plate 32 and is controlled and positioned by a third mounting means (not shown) and retracting means (not shown) through a third slot opening 44 in the chamber wall 12. The holding plate 42 is arranged in such a way that when it is in a fully extended position, it holds an object to be heated at a position of maximal microwave energy.

The elongated cylindrical shaped chamber body 12 allows a more uniform distribution of the microwave energy inside the chamber and furthermore, allows a higher concentration of microwave energy at approximately the center position of the chamber cavity 40. It is believed that at a electromagnetic wave frequency of 2,450 MHz, a TM mode of microwave distribution exists inside chamber 10 which allows maximal heating efficiency.

The retractable object holding plate 42 is made of a material that is microwave transmissive but not absorptive. This allows the microwave energy to penetrate through the plate to reach the object to be heated. The object holding plate 42 can be made of glass, teflon or any other high heat endurance plastic material.

The object holding plate 42 is situated at a predetermined distance from the lower end plate 32 such that any object resting on the holding plate 42 is exposed to maximal microwave energy. In the preferred embodiment, the distance is approximately one-third of the distance between the two end plates.

A microwave generator 50 such as a Magnetron is mounted to a mounting means 52 which sealingly engaging the chamber wall 12. The generator 50 is in microwave transmissible communication with the chamber cavity 40 through connecting flanges 54, 56, circulator 58 equipped with a dummy load 60, a wave guide 62 and protective lens 64. The circulator 58 equipped with a dummy load 60 constructed of heat-dissipating metallic foil 74 is positioned between the microwave generator 50 and the heating chamber 10 to prevent any back flow microwave to damage the generator 50. The circulator 58 acts as a one-way valve for protecting the generator 50. The dummy load 60 is normally made of a ferrite material for absorbing back flow microwave energy. The wave guide 62 situated between the heating chamber 10 and the circulator 58 is used to facilitate the transmission of microwave energy. A protective lens 64 is used at the boundary of the chamber wall 12 and the wave guide 62 such that both the chamber cavity 40 and the mounting means 52 are protected from the intrusion of foreign objects. The protective lens 64 can be made of either glass or teflon type plastic materials.

A control means (not shown) of the conventional type is used to control the first, the second and the third retracting means and the microwave generator to enable the supply of microwave energy to the chamber cavity 40 for heating an object on demand.

The retractable end plate 30 and the lower end plate 32 may alternatively include a seal (not shown) integrally attached to their peripheral edges made of a microwave non-transmissive material to seal the chamber from the outside environment when the two end plates are in fully extended position. Furthermore, the first, second and third slot openings 34, 36 and 44 also include sealing means 72 installed between the slot openings and the retractable plates. This ensures that substantially no microwave can leak to the outside of the chamber wall 12 during the operation of the microwave heating process.

The inside diameter of the microwave heating chamber 10 is generally less than about 25 cm, and preferably less than 20 cm. The length of the elongated cylindrical chamber wall 12 is generally less than 30 cm, and preferably less than 25 cm. It should be recognized that the smaller the chamber interior, the shorter is the heating time required for an object since microwave energy is more concentrated in a smaller chamber.

The heated object can be a food item, a health maintenance item such as a heat wrap, or any other suitable items to be heated. In the heating of a relatively small food item, such as a sandwich, a 20 cm diameter heating chamber can be used which efficiently heats the sandwich in approximately 10 seconds at a microwave power of 600 Watt.

Figure 2:
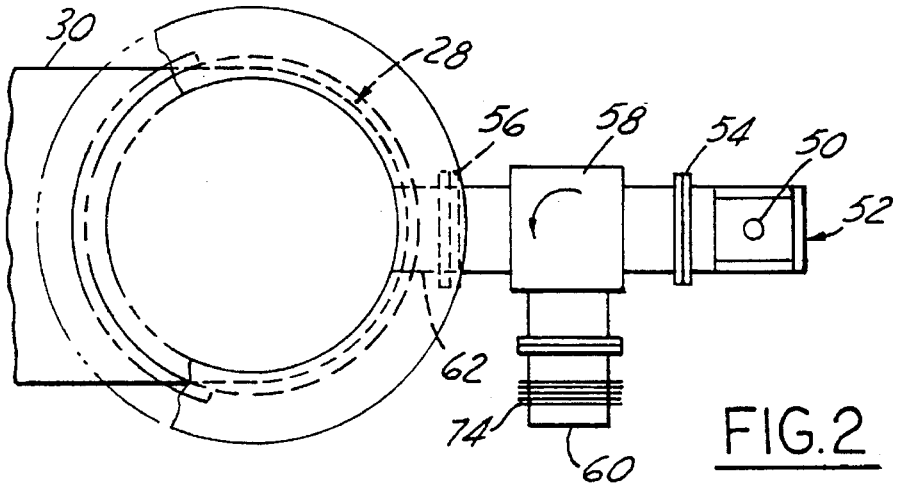
FIG. 2 is a top view of the present invention microwave heating chamber.

FIG. 2 is a top view of the microwave heating chamber 10 shown in FIG. 1. The upper end plate 30 is shown in a fully extended position engaging slot 28 cut into the inside surface 38 of chamber wall 14.

The operation of the present invention microwave heating chamber installed in a vending machine can be described as follows. When a user deposits money and makes a selection, the upper end plate 30, shown in FIG. 1, is retracted by a retracting means (not shown) controlled by a controller (not shown) to allow an object (not shown) to be heated to fall onto the object holding plate 42. The upper end plate 30 then returns to a fully extended position to seal the chamber cavity 40. The microwave generator 50 is already turned-on to a warm-up mode prior to the retraction of plate 30 when a selection button is activated on the vending machine by a user. The closing of the upper end plate 30 turns on the microwave generator 50 so that microwave energy is sent through the circulator 58, the wave guide 62 and the protective lens 64 into the chamber cavity 40 to heat the object situated on the holding plate 42. After a preset time which is determined based on the nature of the object to be heated, i.e. between 5 to 120 seconds, the object is heated to its desired temperature. The microwave generator 50 is then turned-off to stop the generation of microwave. The object holding plate 42 and the lower end plate 32 are retracted simultaneously to allow the heated object to fall by gravity into a discharge chute (not shown) of the vending machine.

While the present invention has been described in an illustrative manner, it should be understood that the terminology used is intended to be in a nature of words of description rather than of limitation.

Furthermore while, while the present invention has been described in terms of a preferred embodiment, it is to be appreciated that those skilled in the art will readily apply these teachings to other possible variations of the invention.

The embodiments of the invention in which an exclusive property or privilege is claimed are defined as follows.

What is claimed is:

1. A microwave heating chamber for use in a vending machine comprising:

a cylindrically shaped chamber having a chamber wall and a longitudinal axis, said chamber is equipped with an upper mounting flange at its upper extremity and a lower mounting flange at its lower extremity, said upper mounting flange being adapted to receive an object transported from a storage compartment, said lower mounting flange being adapted to deliver said object to a discharge chute of said vending machine, a retractable upper end plate for sealingly engaging the inside peripheral area of said chamber when positioned perpendicular to the longitudinal axis of said chamber, said upper end plate being controlled and positioned by a first mounting means and a first retracting means through a first slot opening in the chamber wall of said heating chamber for moving horizontally into and out of said chamber such that when said plate is in a fully extended position, it substantially seals off the upper end of said chamber, a retractable lower end plate for sealingly engaging the inside peripheral area of said chamber when positioned perpendicular to the longitudinal axis of said chamber, said lower end plate being controlled and positioned by a second mounting means and a second retracting means through a second slot opening in the chamber wall of said chamber for moving horizontally into and out of said chamber such that when said lower end plate is in a fully extended position, it substantially seals off the lower end of said chamber and forms a substantially sealed chamber cavity when said upper end plate is also in a fully extended position, said chamber wall and said retractable upper end plate and lower end plate being made of a material that is substantially not transmissive or absorptive to microwave energy, a retractable object holding plate for supporting an object to be heated by microwave energy positioned parallel to said upper end plate and said lower end plate, said object holding plate being controlled and positioned by a third mounting means and retracting means through a third slot opening in the chamber wall of said chamber such that when said holding plate is in a fully extended position, it holds the object to be heated at a position of maximum microwave energy, said retractable object holding plate being made of a material that is transmissive but not absorptive to microwave energy, a microwave generator sealingly engaging the chamber wall of said heating chamber through a mounting means and is in microwave transmissible communication with the chamber cavity of said chamber to supply microwave energy, and a control means for controlling said first, second and third retracting means and said microwave generator to enable the supply of microwave energy to the chamber cavity for heating an object on demand.

2. A microwave heating chamber according to claim 1, wherein said retractable upper end plate and lower end plate further comprise a seal integrally attached to its peripheral edge, said seal being made of a microwave non-transmissive material so as to provide a substantially sealed chamber when the plates are in a fully extended position.

3. A microwave heating chamber according to claim 1, wherein said object holding plate being positioned at a distance above said lower end plate such that objects resting on said holding plate is exposed to maximum microwave energy when such energy is supplied by said microwave generator.

4. A microwave heating chamber according to claim 1, wherein said first, second and third slot openings in said chamber wall further comprises sealing means situated between said slot openings and said retractable upper, lower end plates and said retractable object holding plate such that substantially no microwave can be detected outside the chamber wall during the operation of said heating chamber.

5. A microwave heating chamber according to claim 1, wherein said upper and lower mounting flanges are equipped with mechanical fastening means.

6. A microwave heating chamber according to claim 1, wherein said retractable object holding plate is positioned at a distance from said lower end plate of approximately one-third of the distance between said lower end plate and said upper end plate.

7. A microwave heating chamber according to claim 1, wherein said mounting means for said microwave generator further comprises a circulator equipped with a dummy load, said circulator is positioned between said microwave generator and said heating chamber for preventing any microwave back flow.

8. A microwave heating chamber according to claim 1, wherein said mounting means for said microwave generator further comprises a waveguide positioned between said generator and said heating chamber for facilitating the transmission of microwave energy into said heating chamber.

9. A microwave heating chamber according to claim 1, wherein said mounting means for said microwave generator further comprises a protective lens placed Juxtaposed to the chamber wall for preventing the intrusion of foreign objects from the chamber cavity into the mounting means.

10. A microwave heating chamber according to claim 1, wherein said cylindrically shaped chamber having an inside diameter of not larger than 25 cm.

11. A microwave heating chamber according to claim 1, wherein said cylindrically shaped chamber having a length between said upper and said lower end plates of not longer than 30 cm.

12. A microwave heating chamber according to claim 1, wherein said cylindrically shaped chamber having an inside diameter of not larger than 25 cm and a length between said upper and said lower end plates of not longer than 30 cm.

13. A microwave heating chamber according to claim 1, wherein said object to be heated is a food item.

14. A microwave heating chamber according to claim 1, wherein said chamber wall, said upper and said lower end plates are made of a metallic material selected from the group consisting of stainless steel, aluminum and any other suitable metallic material.

15. A method of heating an object in a vending machine by microwave energy comprising the steps of:

providing a cylindrically shaped heating chamber having a chamber wall and a longitudinal axis, said chamber having an upper mounting flange at its upper extremity adapted to receive an object transported from a storage compartment and a lower mounting flange at its lower extremity adapted to deliver a heated object to a discharge chute of said vending machine, said chamber further having a port in the chamber wall in microwave communication with a microwave generator, providing a retractable upper end plate through a first slot opening in said chamber wall capable of substantially sealing off the upper end of the chamber interior when fully extended into said chamber, providing a retractable lower end plate through a second slot opening in said chamber wall capable of substantially sealing off the lower end of the chamber interior when in a fully extended position into said chamber and forming a chamber cavity with said upper end plate in a fully extended position, said chamber wall and said retractable upper end plate and lower end plate being made of a material that is substantially not transmissive or absorptive to microwave energy, providing a retractable object holding plate through a third slot opening in the chamber wall parallel to said upper and said lower end plates such that the holding plate is capable of holding an object to be heated at a location of maximum microwave energy when placed in a fully extended position, said holding plate being made of a material that is transmissive but not absorptive to microwave energy, retracting said upper end plate by a retracting means to allow an object to be heated to fall onto said object holding plate, delivering microwave energy from said microwave generator into said chamber cavity and heating said object, shutting off said microwave generator after said object is heated for a length of time, and retracting said object holding plate and said lower end plate to allow the heated object to fall by gravity into said discharge chute of said vending machine.

16. A method according to claim 15 further comprising the step of providing a seal along the periphery of said end plates and said slot openings made of a microwave non-transmissive material so as to prevent the leakage of any microwave outside the chamber when both the upper and the lower end plates are in a fully extended position.

17. A method according to claim 15 further comprising the step of positioning the object holding plate from said lower end plate at a distance which is approximately one-third of the distance between said lower and said upper end plates.

18. A method according to claim 15, wherein said object being heated is a food item.

* * * * *